US007051894B2

(12) United States Patent
Barnes et al.

(10) Patent No.: US 7,051,894 B2
(45) Date of Patent: May 30, 2006

(54) CIRCULAR DISPENSING CONTAINER WITH A HINGED LID

(75) Inventors: Robert Cregg Barnes, Hackettstown, NJ (US); Scott Lee Fisher, Evansville, IN (US); Donald Allan Scott, Wadesville, IN (US); David John Jochem, Evansville, IN (US)

(73) Assignee: Wm. Wrigley Jr. Company, Chicago, IL (US)

( * ) Notice: Subject to any disclaimer, the term of this patent is extended or adjusted under 35 U.S.C. 154(b) by 0 days.

(21) Appl. No.: 09/966,761

(22) Filed: Oct. 1, 2001

(65) Prior Publication Data

US 2003/0062368 A1 Apr. 3, 2003

(51) Int. Cl.
*B65D 51/18* (2006.01)

(52) U.S. Cl. ..... 220/254.5; 220/281; 220/254.3; 220/283; 220/839; 220/819; 220/817; 206/540

(58) Field of Classification Search ..... 215/235, 215/237; 220/4.21, 4.24, 4.25, 254.5, 254.3, 220/254.1, 262–264, 281–283, 817, 819, 220/826, 836–838, DIG. 13, 523, 259.1; 206/538, 540, 533; 222/556, 517; D9/428, D9/339; 43/54.1
See application file for complete search history.

(56) References Cited

U.S. PATENT DOCUMENTS 2,046,869 A * 7/1936 Burke ..... 206/533
2,267,640 A * 12/1941 De Witt ..... 312/35
2,621,782 A * 12/1952 Reifers ..... 206/540
3,419,198 A * 12/1968 Pettersen ..... 222/541.2
4,413,742 A * 11/1983 Sandhaus ..... 215/216
4,607,768 A * 8/1986 Taber et al. ..... 222/556
D321,788 S * 11/1991 Chen ..... D3/74
5,065,912 A * 11/1991 Rosenthal ..... 222/517
5,273,177 A 12/1993 Campbell
5,361,908 A * 11/1994 Drew et al. ..... 206/536
D359,448 S * 6/1995 Aronson ..... D9/428
5,477,981 A * 12/1995 Heyl et al. ..... 221/86
5,718,347 A * 2/1998 Walker et al. ..... 215/209
5,782,359 A * 7/1998 McAllister et al. ..... 206/538
5,899,335 A * 5/1999 Boyer et al. ..... 206/538
D436,034 S 1/2001 Wolff
6,185,906 B1 2/2001 Mogard et al.
6,250,049 B1 6/2001 Feldman et al.
6,394,298 B1 * 5/2002 Zaidman ..... 220/259.1

OTHER PUBLICATIONS

"Mini pack marks 50 years of Polos", Jun. 18, 1998, Packaging Magazine, vol. 1, No. 12, p. 5.*
4 photocopies of pictures identifying a "Polo" container.*

* cited by examiner

*Primary Examiner*—Robin A Hylton
(74) *Attorney, Agent, or Firm*—Stites & Harbison PLLC; Marvin Petry

(57) ABSTRACT

A dispensing container is formed from a toroidal-shaped body having a top surface, a bottom surface, and opposing outer and inner sidewalls defining a hollow interior and a central void. A lid having a tab portion hinged to an actuator portion covers part of the top surface of the body and is dimensioned to cover the aperture. The actuator is depressable to cause the tab portion to pivot away from the aperture, thereby allowing one to dispense the contents present in the container.

12 Claims, 4 Drawing Sheets

CIRCULAR DISPENSING CONTAINER WITH A HINGED LID

FIELD OF THE INVENTION

The present invention relates to a container and, in particular, to a circular dispensing container for dispensing food products.

BACKGROUND OF THE INVENTION

Containers for packaging and dispensing food products such as candy come in a wide variety of sizes and shapes. These containers may be handheld and adapted to fit in a purse or in a pocket of a shirt or pair of pants. Further, these containers help to prevent damage to the food product contained within and to maintain its freshness. Typically, conventional dispensing containers for food products such as candy include a lid, cap or other covering which is removed for gaining access to and dispensing the food product from the container.

One known conventional dispensing container has a toroidal-shaped body with a flip top lid. The lid has a depressable, actuator portion and tab portion. The lid covers nearly the entire top surface of the container while each portion covers approximately one half thereof. Upon depressing the actuator portion, the tab portion flips upward to its opened position, thereby exposing a small opening in the top surface of the container located at a mid-point of the top surface which is covered by the tab portion.

There exists a need for new and improved containers for dispensing food products such as candy.

BRIEF SUMMARY OF THE INVENTION

In accordance with a general object of the present invention, a container is provided for storing and dispensing food product such as candy, wherein the container mimics the shape of the food product which may be disposed therein and includes an improved opening structure.

It is an additional object of the present invention to provide a food product dispensing container with an easy opening tab for dispensing food product such as candy from the container.

In accordance with one aspect of the present invention, a dispensing container includes a toroidal-shape body having a hollow interior and having a top surface with an aperture. A lid has a tab portion which is hinged to an actuator portion and which covers the aperture. The lid extends circumferencially a distance of less than 180° around the top surface while the tab portion covers the aperture and the actuator portion is depressable to cause the tab portion to pivot away from the aperture for gaining access to the hollow interior.

According to another aspect of the present invention, a container includes a toroidal-shaped body having a top surface, a bottom surface, and opposing outer and inner sidewalls defining a hollow interior with a central void. The top surface has an aperture. Covering a portion of the top surface is a lid having a tab portion hinged to an actuator portion. The lid extends circumferencially a distance of less than 180° around the top surface while the tab portion extends less than 90° around the top surface and is dimensioned to cover the aperture. The actuator portion is depressable to cause the tab portion to pivot away from the aperture for gaining access to said hollow interior.

Further features and advantages of the present invention will be set forth in, or apparent from, the detailed description of preferred embodiments thereof which follows.

BRIEF DESCRIPTION OF THE DRAWINGS

The invention will now be described in detail with respect to preferred embodiments with reference to the accompanying drawings, wherein.

DETAILED DESCRIPTION OF THE INVENTION

Figure 1:
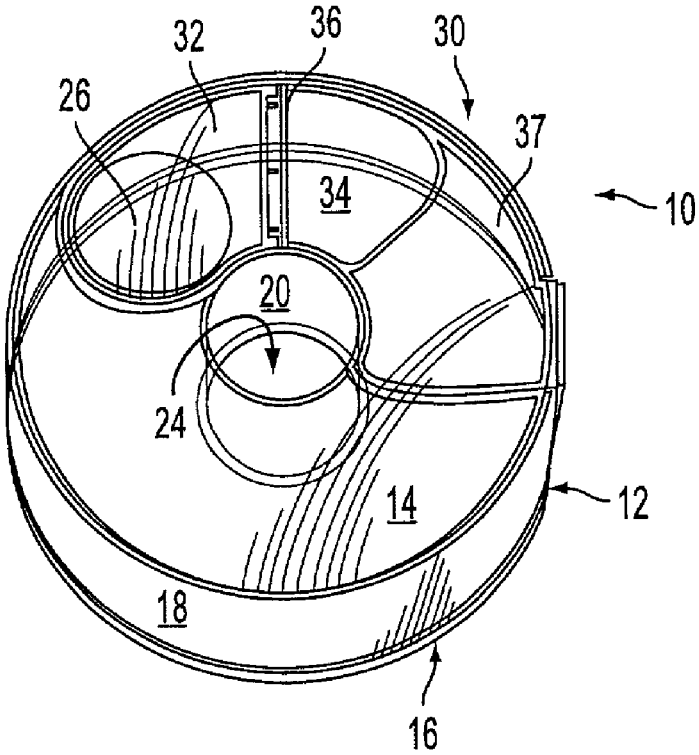
FIG. 1 is a perspective view of a dispensing container according to the invention, in a closed condition.
Figure 2:
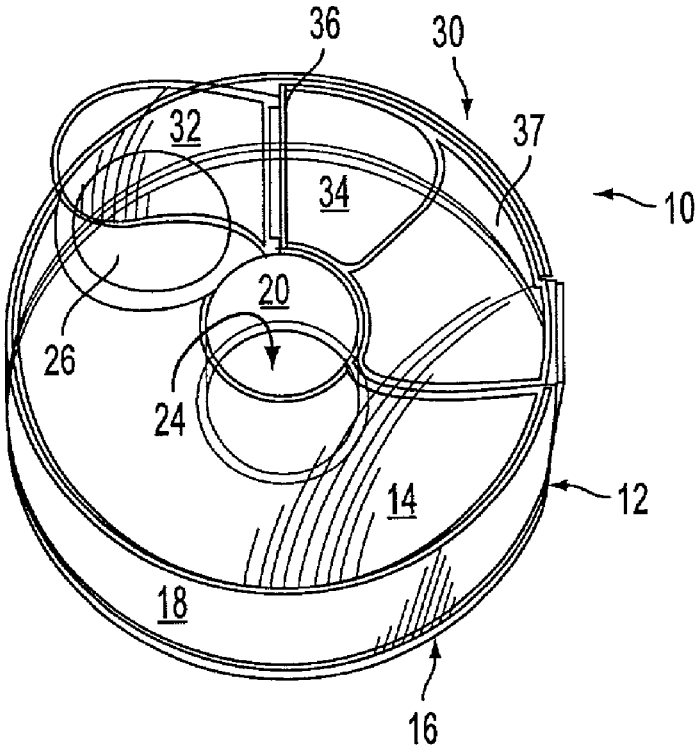
FIG. 2 is a perspective view of the container of FIG. 1 in a opened condition.
Figure 3:
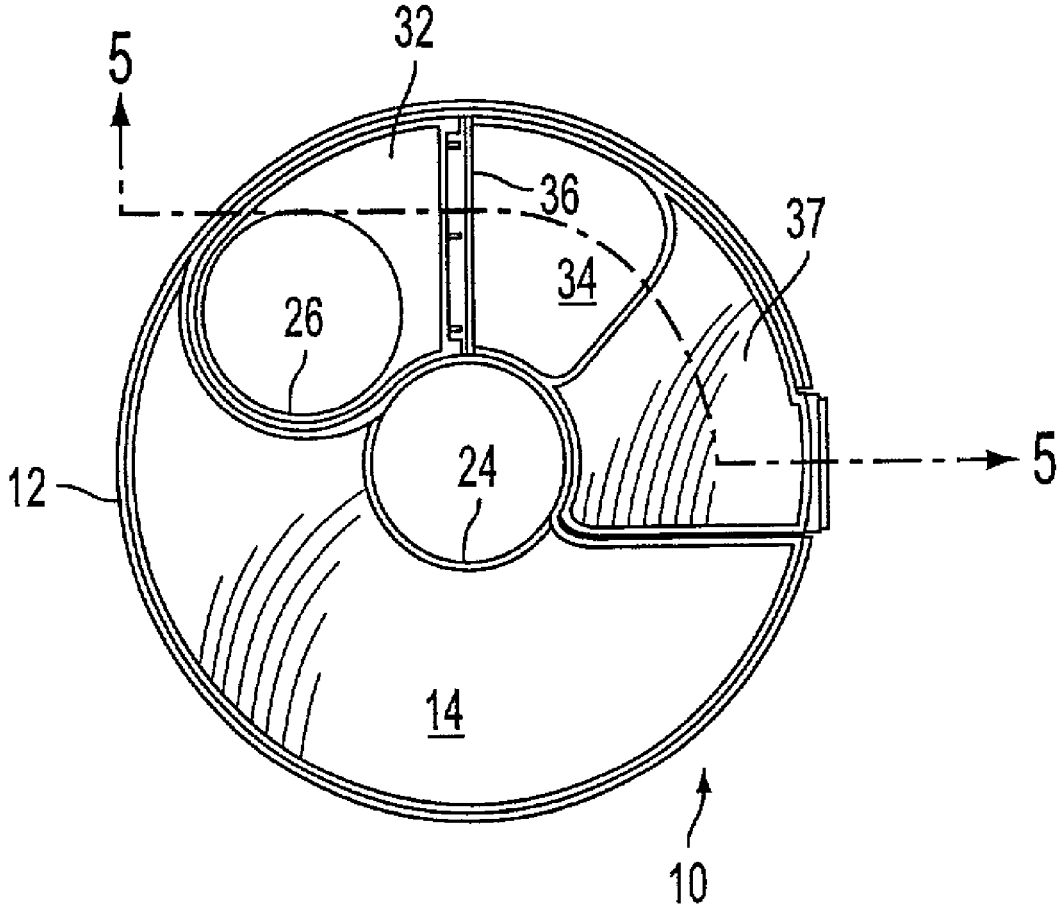
FIG. 3 is a plan view of the container of FIG. 1.

Referring now to the drawings, like numbers represent like elements throughout the several views. Reference numeral 10 generally identifies a dispensing container depicted in a closed condition in FIGS. 1, 3 and 5 and in an opened condition in FIGS. 2 and 6. The container 10 includes a toroidal-shaped body 12 having a top surface 14, a bottom surface 16 and opposing outer sidewall 18 and inner sidewall 20. Advantageously, container 10 is formed from plastic or a polymer such as polypropylene or other suitable material, and is preferably transparent.

Bottom surface 16 and top surface 18 are curved, both being convex outwardly. The outer sidewall 18 and inner sidewall 20 are cylindrical and coaxial with respect to each other.

The body 12 defines a hollow interior 22 and a center void 24. An aperture 26 is formed through the top surface 14.

A lid 30 (best shown in FIG. 4) is dimensioned to cover aperture 26 and comprises a tab portion 32 attached to an actuator portion 34 via hinge 36. Actuator portion 34 is offset below the lid surface 37. The outside of lid surface 37 has the same convex contour as that of top surface 14 whereby lid surface 37 and top surface 14 provide a uniform, convex contoured surface to container 10.

Tab portion 32 is flipped to an open position by applying a downward force to depress actuator portion 34. The downward force causes tab portion 32 to pivot away from aperture 26, transforming container 10 from a closed condition (FIG. 1) to an opened condition (FIG. 2), thereby allowing one to dispense food product present in container 10.

Tab portion 32 extends circumferencially a distance of approximately seventy-five degrees around the top surface 14 and terminates proximate the edge of aperture 26. Although preferable that tab portion 32 extends circumferentially only about seventy-five degrees, tab portion 32 can extend up to 120° around the top surface 14.

Figure 4:
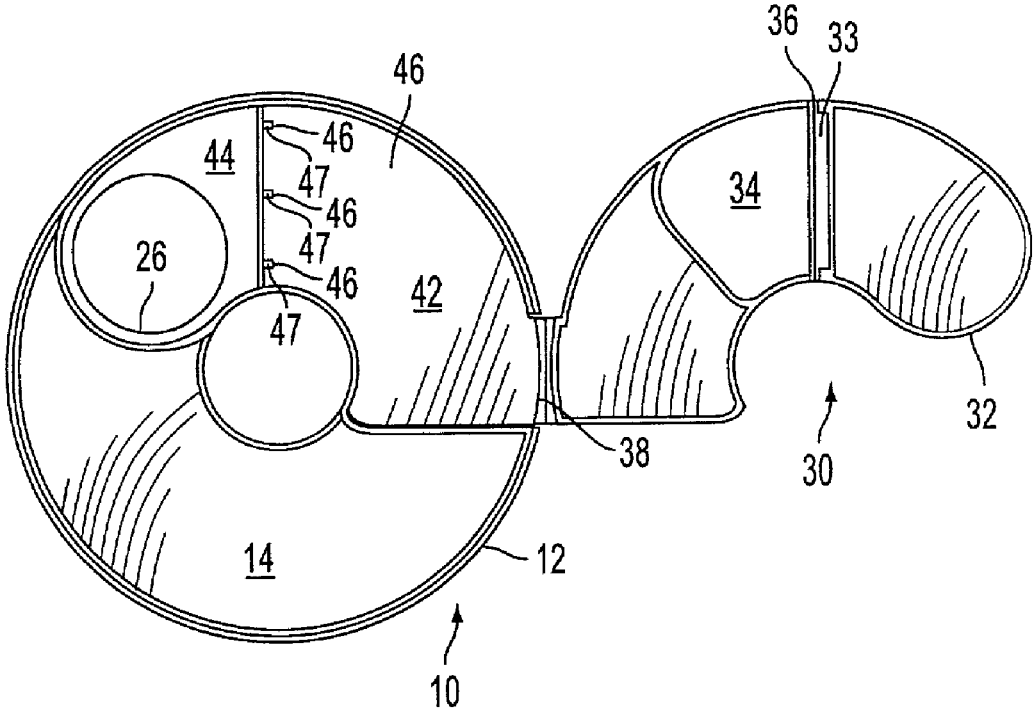
FIG. 4 is a plan view of the container with lid removed from the top surface.
Figure 5:
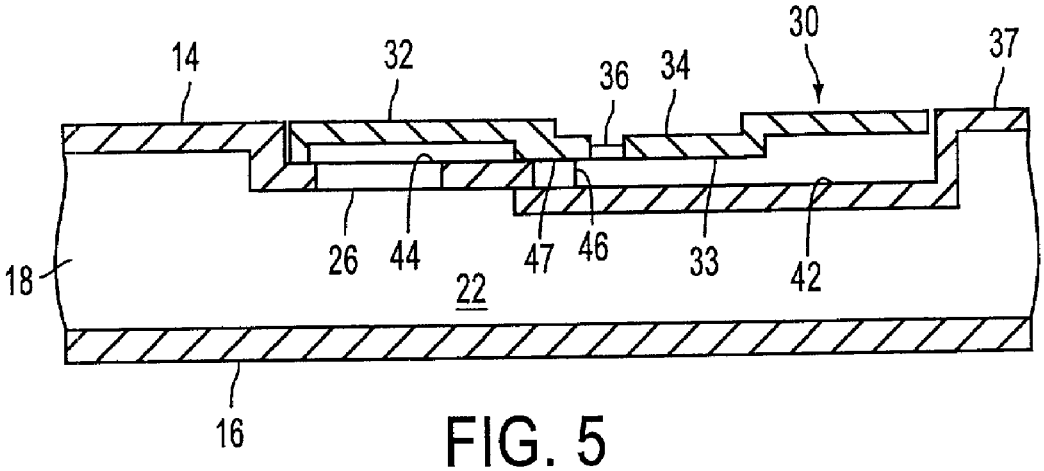
FIG. 5 is an enlarged partial sectional view of the container taken along line 5—5 of FIG. 3 in the closed position.

Lid 30 snaps into place on body 12 by pivoting on hinge 38 so as to cover a first recess 42 and a second recess 44 (best shown in FIGS. 4 and 5). The first recess 42 is deeper relative to the second recess 44. A plurality of protuberances 46 with respective engaging surfaces 47 extend from the surface of recess 42. When snapped in place, tab portion 32 covers second recess 44 with tab bottom 33 disposed over, and abutting engaging surfaces 47 of the plurality of protuberances 46, thereby forming a closed container configuration as depicted in FIG. 5.

Figure 6:
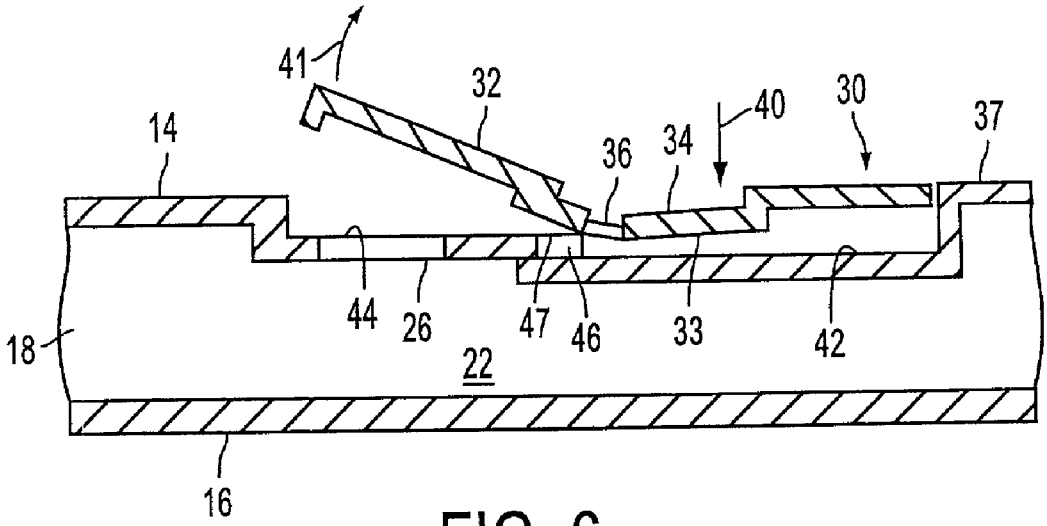
FIG. 6 is a view similar to FIG. 5 but showing the container in an opened position.

Further understanding of the operation of lid 36 is provided with reference to FIGS. 5 and 6. FIG. 5 shows the operative lid parts enlarged and in a closed position. Upon pressing the actuator portion 34, i.e. applying a force the direction denoted by arrow 40, actuator portion 34 is forced downwardly causing bottom 33 of tab portion 32 to be forced against engaging surfaces 47, thereby urging tab portion 32 to pivot about hinge 36 upwardly away from aperture 26 in the direction denoted by arrow 41 to the position as shown in FIG. 6.

Preferably, tab portion 32 can be flipped open by holding container 10 in the palm of one hand while pressing actuator portion 34 using the thumb of that hand. Food product such as candy is then dispensed into the other hand by slightly inverting or pouring the food product present in the container 10 into the other hand.

It will be apparent to one of ordinary skill in the art that container 10 provides numerous features and advantages. For example, the offset actuator portion 34 enables one to easily locate and depress the optimal area to easily dispense food product such as candy from container 10. Further, the preferable size of container 10 provides for a dispensing container which can fit in the palm of a hand for easy dispensing of food product and which can readily be stowed in a purse or in a shirt, pants, or backpack pocket.

Although the invention has been described in detail with respect to preferred embodiments thereof, it will be apparent to one skilled in the art that the invention is capable of numerous modifications and variations within the spirit and scope of the invention.

What is claimed is:

1. A dispensing container comprising:

a toroidal-shaped body having a hollow interior and having a top surface with an aperture; and a lid having a tab portion hinged to an actuator portion at a radial hinge located on a radius of the body and covering a portion of said top surface, said tab portion extending circumferentially from said radial hinge a distance less than 90° around said top surface to a free end positioned and dimensioned to cover said aperture, said actuator portion being depressable to cause said tab portion to pivot about said radial hinge away from said aperture for gaining access to said hollow interior.

2. The container of claim 1, wherein the outer surfaces of said top and bottom surfaces are outwardly convex.

3. The container of claim 1, wherein said tab portion comprises a tab bottom portion abutting an engaging surface of said top surface, whereby said tab bottom portion pivotally pivots about said engaging surface when said actuator portion is depressed, thereby causing said tab portion to pivot away from said aperture.

4. A dispensing container comprising:

a toroidal-shaped body having a top surface, a bottom surface, and opposing outer and inner sidewalls defining a hollow interior with a central void, said top surface having an aperture; and a lid having a tab portion hinged to an actuator portion at a radial hinge located on a radius of the body and covering a portion of said top surface, said tab portion extending circumferentially from said radial hinge a distance less than 180° around said top surface to a free end positioned and dimensioned to cover said aperture and terminating at substantially the edge of said aperture, said actuator portion being depressable to cause said tab portion to pivot about said radial hinge away from said aperture for gaining access to said hollow interior.

5. The container of claim 4, wherein said bottom surface, a portion said top surface and a lid top surface are outwardly convex.

6. The container of claim 4, wherein said opposing outer and inner sidewalls are cylindrical and coaxial.

7. The container of claim 4, wherein said tab portion comprises a tab bottom portion abutting an engaging surface of said top surface, whereby said tab bottom portion pivotally pivots along said engaging surface when said actuator portion is depressed, thereby causing said tab portion to pivot away from said aperture.

8. The container of claim 4, wherein the lid is hinged to the container at a location remote from the tab portion.

9. The container of claim 8, wherein the top of the toroid, including the outer surface of the lid, is uniformly outwardly convex.

10. The container of claim 9, wherein the said bottom surface is uniformly outwardly convex.

11. The container of claim 8, wherein the lid extends less than 90 about the circumference of the container.

12. The container of claim 4, wherein the lid, in a position to close the aperture together with the top outer surface of the container is uniformly outwardly convex about its complete circumference and wherein the said bottom surface of the container is also uniformly outwardly convex and of a shape similar to the convexity of the top outer surface of the container.

* * * * *